US006142734A

United States Patent [19]

Lee

[11] Patent Number: 6,142,734

[45] Date of Patent: Nov. 7, 2000

[54] INTERNALLY GROOVED TURBINE WALL

[75] Inventor: Ching-Pang Lee, Cincinnati, Ohio

[73] Assignee: General Electric Company, Cincinnati, Ohio

[21] Appl. No.: 09/286,802

[22] Filed: Apr. 6, 1999

[51] Int. Cl.[7] ..... F01D 5/18

[52] U.S. Cl. ..... 416/97 R; 416/96 R; 415/115; 249/117

[58] Field of Search ..... 416/96 R, 96 A, 416/97 R; 415/115, 116, 177, 178, 173.1; 29/527.5, 527.6; 249/117

[56] References Cited

U.S. PATENT DOCUMENTS 5,201,847 4/1993 Whidden ..... 415/177
5,337,568 8/1994 Lee et al. .
5,468,125 11/1995 Okpara et al. ..... 416/97 R
5,586,866 12/1996 Wettstein ..... 416/96 A
5,738,493 4/1998 Lee et al. ..... 416/97 R

*Primary Examiner*—Edward K. Look
*Assistant Examiner*—Rhonda Barton
*Attorney, Agent, or Firm*—Andrew C. Hess; Rodney M. Young

[57] ABSTRACT

A turbine wall includes an outer surface for facing combustion gases, and an opposite inner surface for being impingement air cooled. A plurality of adjoining ridges and grooves are disposed in the inner surface for enhancing heat transfer by the impingement cooling air.

43 Claims, 5 Drawing Sheets

INTERNALLY GROOVED TURBINE WALL

BACKGROUND OF THE INVENTION

The present invention relates generally to gas turbine engines, and, more specifically, to turbine cooling therein.

In a gas turbine engine, air is pressurized in a compressor, mixed with fuel in a combustor and ignited for generating hot combustion gases, which flow downstream through one or more turbine stages for extracting energy therefrom. A high pressure turbine (HPT) firstly extracts energy from the gases for powering the compressor. And, additional energy is typically extracted from the gases by a low pressure turbine (LPT) which typically powers a fan disposed upstream from the compressor.

The HPT includes a stationary turbine nozzle which directly receives the combustion gases from the combustor for redirecting the gases into a row of rotary turbine blades extending radially outwardly from a rotor disk. The nozzle includes a plurality of circumferentially spaced apart stator vanes which complement the performance of the rotor blades.

Both the vanes and blades are suitably configured as a airfoils which cooperate for maximizing efficiency of extraction of energy from the combustion gases which flow thereover. The vane and blade airfoils have generally concave pressure sides and opposite, generally convex suction sides which extend axially between corresponding leading and trailing edges thereof and radially over their radial span.

The nozzle vanes extend radially between annular outer and inner bands which confine the combustion gases therebetween. The blade airfoils extend from their radially inner roots to their radially outer tips which are spaced closely radially inwardly from a surrounding annular turbine shroud. The shroud is stationary and defines the outer boundary for the combustion gases which flow past the rotating blade airfoils.

Since the stator vanes, rotor blades, and turbine shrouds are directly exposed to the combustion gases, they require suitable cooling for maintaining their strength and ensuring suitable useful lives thereof. These components are typically cooled by channeling thereto corresponding portions of air bled from the compressor which is substantially cooler than the hot combustion gases. Various cooling techniques are used in cooling gas turbine engine components. Film cooling is one technique wherein air is channeled through inclined film cooling holes to form a film of cooling air between the outer or exposed surfaces of the components and the hot combustion gases which flow thereover.

Impingement cooling is another technique wherein the cooling air is initially directed substantially normal to the inner surfaces of these components in impingement thereagainst for removing heat therefrom by convection heat transfer. The inner surfaces may be smooth for impingement cooling, or may include three dimensional turbulators in the form of cylindrical pins, bumps, or dimple depressions. These turbulators increase the effective surface area of the inner surfaces from which heat may be extracted. The turbulators are typically small in size for reducing any adverse pressure drop caused thereby for ensuring cooling efficiency.

Since turbine vanes, blades, and shrouds are formed of high strength metals, they are typically manufactured by casting for achieving maximum material strength and precision of the small features thereof, including any turbulators which may be used therein.

The vanes and blades are hollow for channeling therethrough the cooling air in several radially extending passages. The passages may be individually fed with cooling air or may be arranged in serpentine legs through which the cooling air flows. Impingement cooling for the vanes is typically provided by placing perforated impingement baffles inside corresponding internal passages therein. The cooling air is first channeled inside the baffle and then laterally through its perforations for impingement against the inner surface of the vane.

Since turbine blades rotate during operation, an integral rib or bridge may be provided between its pressure and suction sides for defining an integral baffle having holes or perforations through which the cooling air is directed in impingement against the inner surface of the blade airfoil, typically along the leading edge.

Both the vane and blade airfoils may be similarly cast in view of their common airfoil configurations with internal radial passages. The internal passages are defined by corresponding ceramic cores surrounded by wax which defines the configuration of the final airfoil. The wax is then surrounded by a ceramic shell, and subsequently removed in the lost wax method. Molten metal is then poured between the shell and core and solidifies in the form of the desired airfoil. The ceramic shell and cores are then removed to expose the cast airfoil.

The ceramic cores themselves are produced in a separate casting process using a metallic core die precisely formed with the mirror features to be produced in the outer surface of the core. A typical core die may be formed in two or more halves with an internal passage being defined therebetween and extending along the span axis thereof. A ceramic slurry or paste is injected under significant pressure in the open end of the die to fill the die, after which the resulting ceramic core is removed and cured.

The same core die is used repeatedly for casting multiple copies of the airfoils. However, the injection of the ceramic slurry into the die eventually leads to wear therein. Wear is most pronounced for three dimensional features such as the turbulators for enhancing impingement cooling, which turbulators of the core die are abraded over extended use. Once the die is worn, a new die must be manufactured at considerable expense.

Accordingly, it is desired to provide improved impingement cooling features in a turbine component, which can reduce core die wear in a preferred embodiment.

BRIEF SUMMARY OF THE INVENTION

A turbine wall includes an outer surface for facing combustion gases, and an opposite inner surface for being impingement air cooled. A plurality of adjoining ridges and grooves are disposed in the inner surface for enhancing heat transfer by the impingement cooling air.

DETAILED DESCRIPTION OF THE INVENTION

Figure 1:
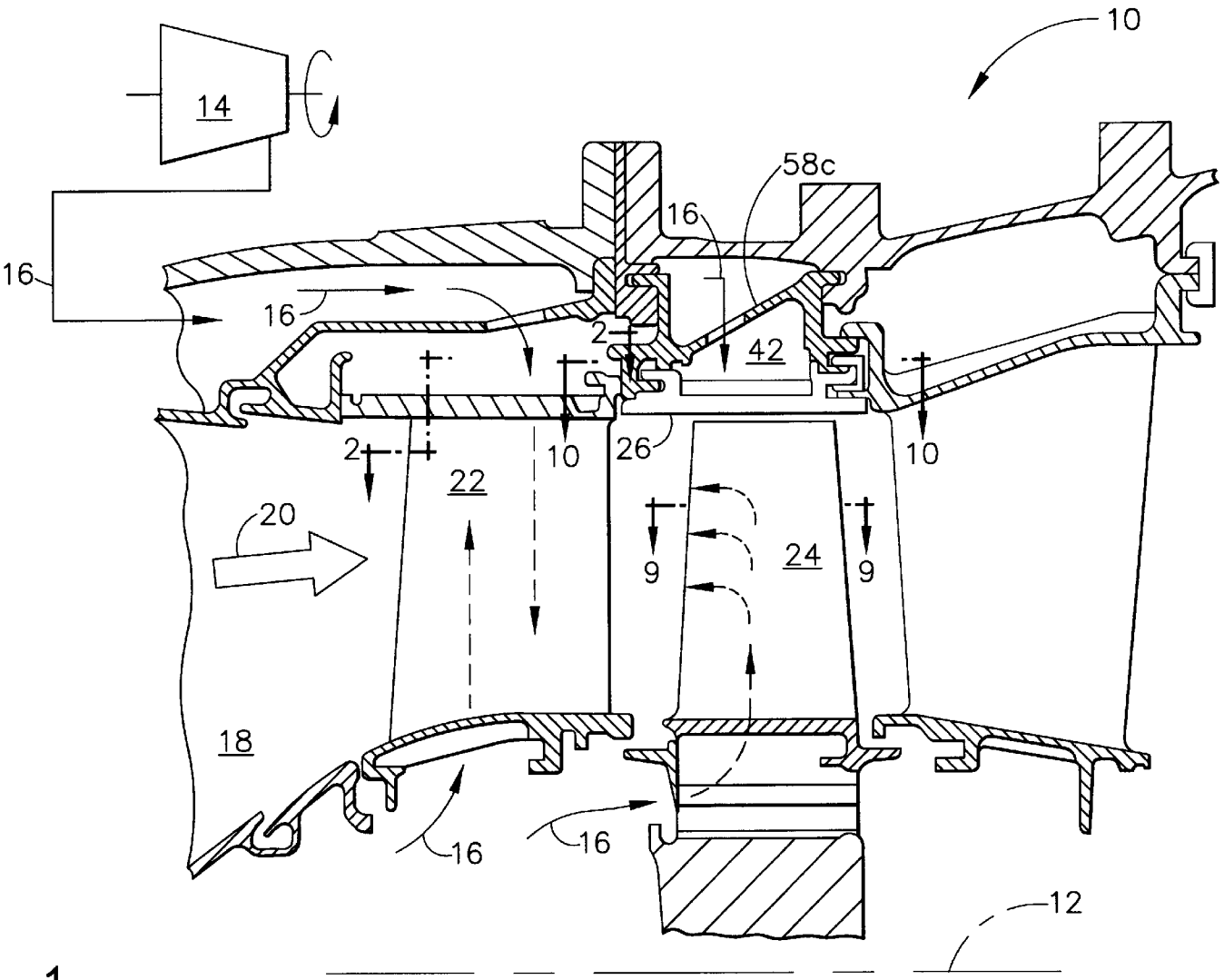
FIG. 1 is an elevational, axial sectional view through a high pressure turbine portion of a gas turbine engine.

Illustrated in FIG. 1 is a portion of a gas turbine engine 10 which is axisymmetrical about a longitudinal or axial centerline axis 12. The engine includes a multistage axial compressor 14 configured for pressurizing air 16, portions of which are bled for later use in cooling the engine.

The major portion of the air from the compressor is channeled to an annular combustor 18, shown in aft part, wherein the air is mixed with fuel and ignited for generating hot combustion gases 20 which flow downstream into a high pressure turbine (HPT). The turbine includes an annular turbine nozzle having a plurality of circumferentially spaced apart stator vanes 22 extending radially between annular outer and inner bands.

The high pressure turbine also includes a row of rotor blades 24 which extend outwardly from a supporting rotor disk, and are secured thereto by integral axial dovetails. Surrounding the rotor blades 24 is an annular turbine shroud 26 typically formed of a plurality of circumferentially adjoining arcuate shroud segments.

During operation, the combustion gases 20 are discharged from the combustor between the nozzle vanes 22 for flow in turn between the downstream rotor blades 24 which extract energy therefrom for in turn rotating the supporting disk, which in turn powers the compressor 14. The combustion gases then flow downstream through a low pressure turbine, with the first nozzle stage thereof being illustrated, which also includes one or more rows of turbine blades (not shown) which extract additional energy from the gases for typically powering a fan (not shown) upstream of the compressor.

The engine 10 as above described is conventional in configuration and operation. The engine is also conventional in bleeding corresponding portions of the pressurized air 16 for use in cooling various turbine components such as the nozzle vanes 22, HPT rotor blades 24, and the HPT shroud 26. These components are typically cooled by convection, film cooling, and impingement cooling in conventional manners for maximizing cooling efficiency of the air while minimizing pressure losses therein.

In accordance with the present invention, impingement cooling features for the vanes 22, blades 24, and shroud 26 may be varied for obtaining various performance and casting advantages.

Figure 2:
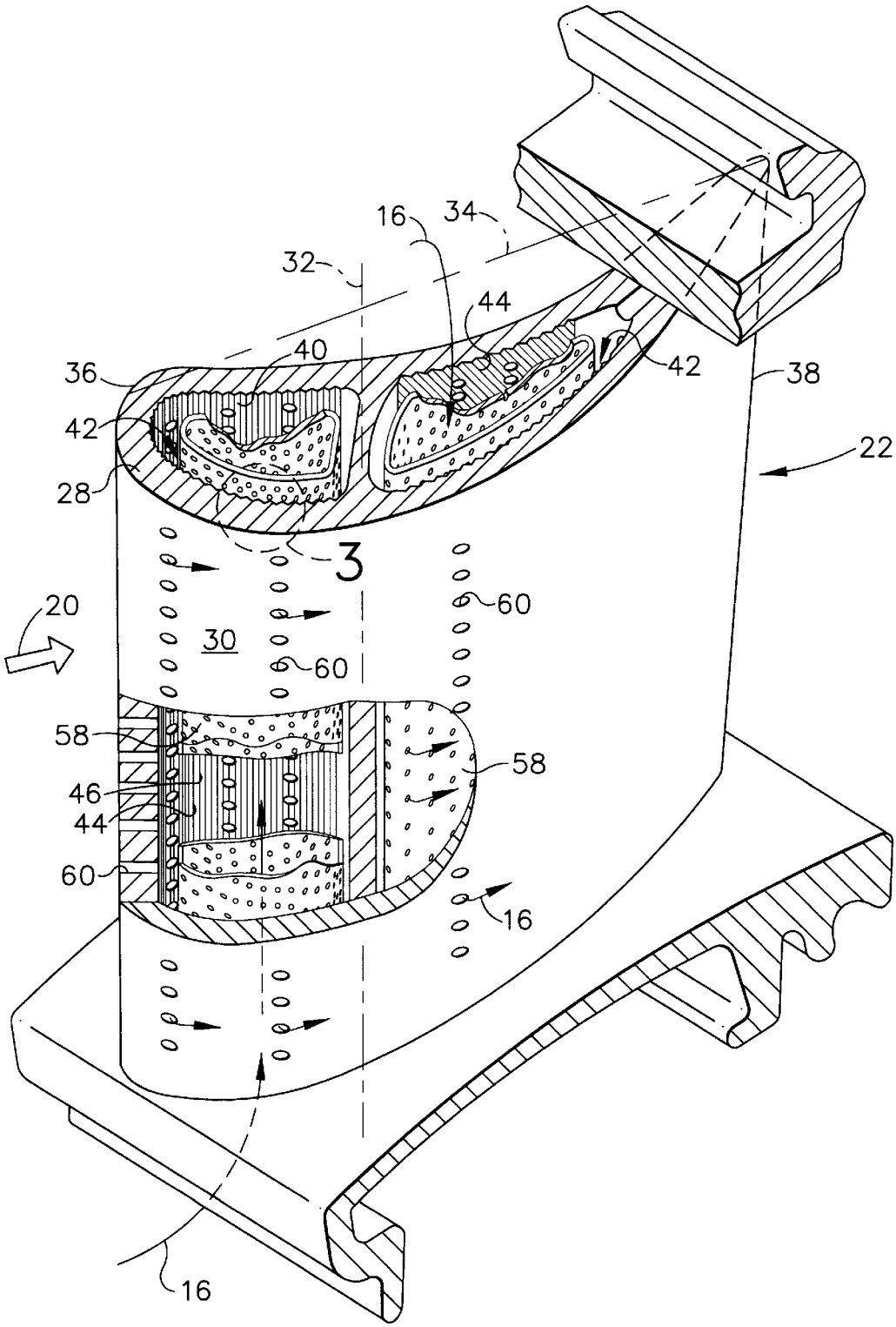
FIG. 2 is a partly sectional, isometric view of a portion of the turbine nozzle illustrated in FIG. 1 and taken generally along line 2—2.

More specifically, FIG. 2 illustrates one of the turbine nozzle vanes 22 in accordance with an exemplary embodiment of the present invention. The vane 22 is in the form of an enclosing wall 28 which defines an airfoil. The vane has an outer surface 30 defining a generally concave pressure side and an opposite, generally convex suction side which face the combustion gases 20 which flow thereover during operation. The vane outer surface 30 extends radially or longitudinally along a span axis 32, and axially or laterally along a chord axis 34 between an upstream leading edge 36 and downstream trailing edge 38 of the vane.

The vane wall 28 also includes an opposite internal or inner surface 40 which defines a radially extending inner passage or cavity 42 extending along the span axis for channeling the cooling air 16 therethrough.

In accordance with the present invention, the vane inner surface 40 includes a plurality of adjoining ridges 44 and grooves 46 for improving heat transfer and impingement cooling from the available air, as well as providing improvements in vane casting in a suitable embodiment.

The ridges 44 and grooves 46 are parallel to each other and preferably directly adjoin each other side-by-side for increasing surface area available for cooling by the cooling air 16 without introducing appreciable pressure losses therein. The vane is heated from the outside by the combustion gases 20 which flow thereover, with the cooling air 16 being provided inside the vane for internal cooling thereof. Without the ridges and grooves, a smooth inner surface of the vane has limited heat transfer surface area for being cooled. By introducing the relatively small ridges and grooves, a significant increase in surface area inside the vane is obtained from which the cooling air 16 may extract additional heat from the underlying vane wall 28 for improving the cooling thereof during operation.

Figure 3:
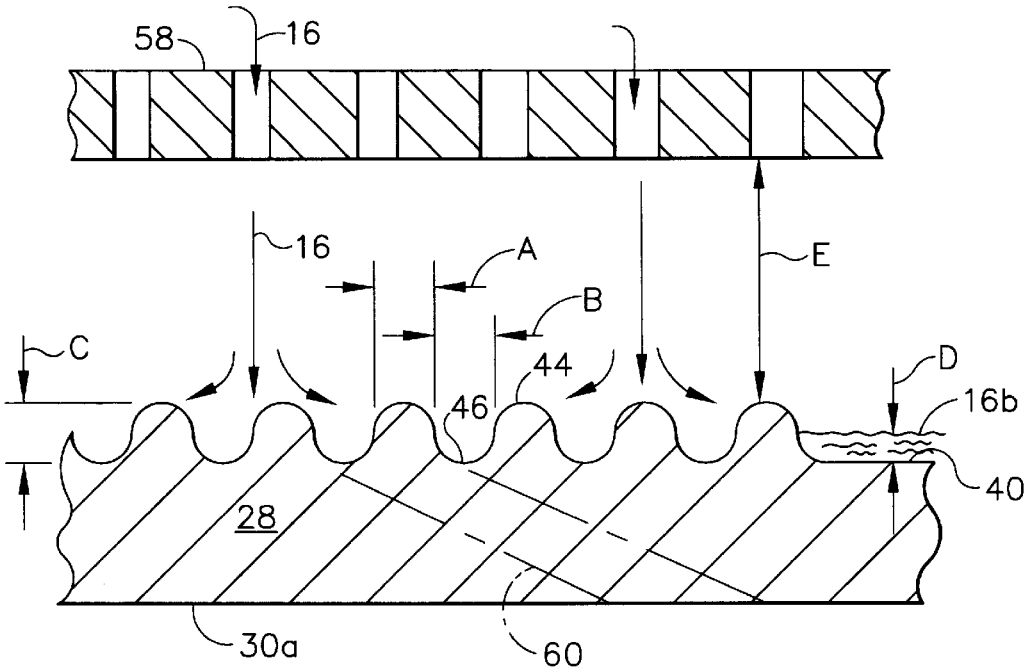
FIG. 3 is an enlarged radial cross section view of the vane airfoil and internal baffle illustrated in FIG. 2 within the dashed circle labeled 3.

FIG. 3 illustrates an enlarged view of a typical cross section of a portion of the vane wall 28. In one embodiment, each of the ridges 44 has a width A, and each of the grooves 46 has a width B, with the ridges and grooves being generally equal in width.

Each of the ridges 44 has a height C, which is the same as the corresponding depth of the adjoining groove 46, which is sufficiently tall for both increasing effective surface area and interrupting the boundary layer of cooling air formed along the vane inner surface during operation. As shown schematically in FIG. 3, a boundary layer 16*b* of the air 16 will form during operation over the inner surface of the vane. The boundary layer is typically turbulent and has a thickness D during operation. The ridges 44 are preferably sized in height C to slightly exceed the boundary layer thickness D for increasing heat transfer cooling during operation, without introducing excessive pressure losses due to excess height. For example, the height C of the ridges 44 may be in the exemplary range of about 15–25 mils. Correspondingly, the ridge width A and the groove width B may each also be in this exemplary range of about 15–25 mils. These small values are sufficient for exceeding the height of the cooling air boundary layer formed inside the vanes during operation and providing a substantial increase in surface area available for cooling without significant pressures losses associated therewith.

The ridges 44 and grooves 46 illustrated in the exemplary embodiment of FIG. 3 are sized and configured to increase the surface area of the vane inner surface 40 by about 100%. Since the ridges and grooves have substantially equal width and height, the two sides bounding each ridge and groove effectively double the available surface area subject to cooling by the air 16.

In the exemplary embodiment illustrated in FIG. 3, the ridges 46 are semicircular or convex in cross section at their tops and meet the grooves 46 which are also semicircular, but concave at their bottoms. The ridges and grooves are thusly complementary with each other having compound side surfaces transitioning from concave to convex at their mid-heights having inflection points. This configuration reduces stress concentrations while providing smooth contours along which the cooling air 16 may flow parallel along the lengths of the ridges and grooves, and in cross-flow laterally thereacross from ridge to ridge.

Figure 4:
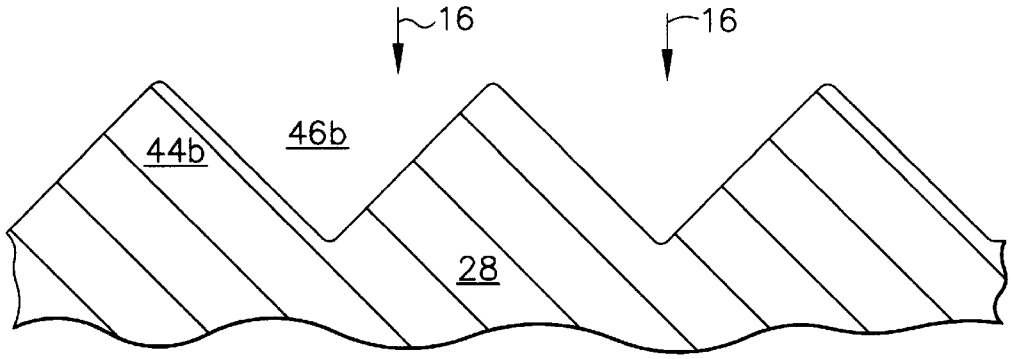
FIG. 4 is an enlarged sectional view of an alternate embodiment of the ridges and grooves illustrated in FIG. 3.

FIG. 4 illustrates an alternative embodiment of the ridges and grooves of FIG. 3 designated 44*b,* and 46*b,* respectively. In this embodiment, the ridges 44*b* are triangular in cross section, and correspondingly the adjoining grooves 46*b* are triangular in cross section in a sawtooth pattern, with small radii at the tips of the ridges and the bases of the grooves.

Figure 5:
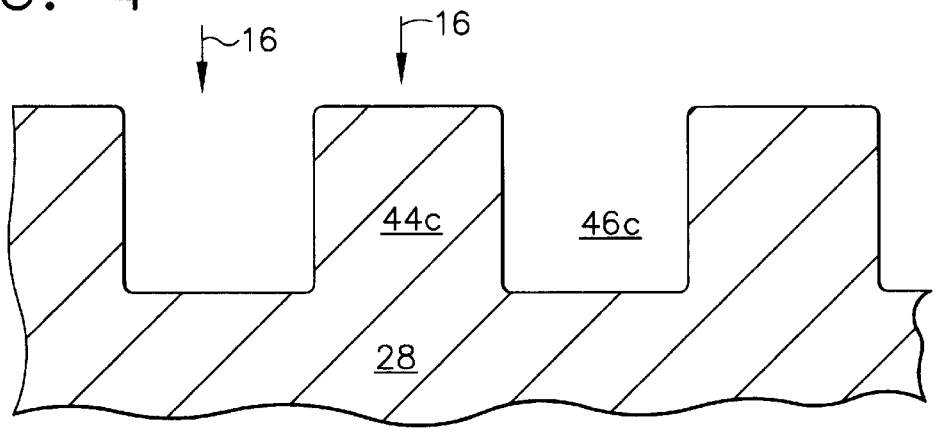
FIG. 5 is an enlarged sectional view of an alternate embodiment of the ridges and grooves illustrated in FIG. 3.

FIG. 5 illustrates yet another embodiment of the ridges and grooves of FIG. 3 designated 44*c* and 46*c,* respectively. In this embodiment, the ridges 44*c* are flat along their tops between adjacent grooves 46*c,* with both the ridges 44*c* and grooves 46*c* being rectangular in cross section in a square-wave form.

In this embodiment, the grooves 46*c* are flat at their bases between adjacent ridges 44*c,* with the sidewalls extending perpendicularly between the tops of the ridges and the bottoms of the grooves also being flat. With equal widths and heights of the ridges and grooves illustrated in FIG. 5, the available surface area subject to cooling is double that of the surface without the ridges and grooves therein.

Figure 6:
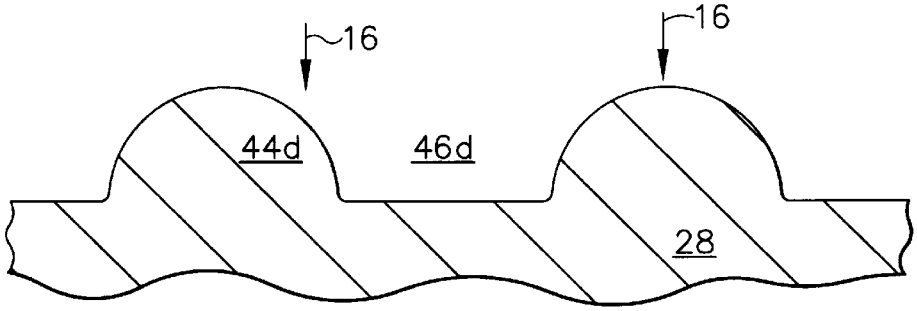
FIG. 6 is an enlarged sectional view of an alternate embodiment of the ridges and grooves illustrated in FIG. 3.

FIG. 6 illustrates yet another embodiment of the ridges and grooves of FIG. 3 designated 44*d,* and 46*d,* respectively. In this embodiment, the ridges 44*d* are semicircular or convex in cross section, and the adjoining grooves 46*d* are flat therebetween and aligned along the maximum diameters thereof.

Figure 7:
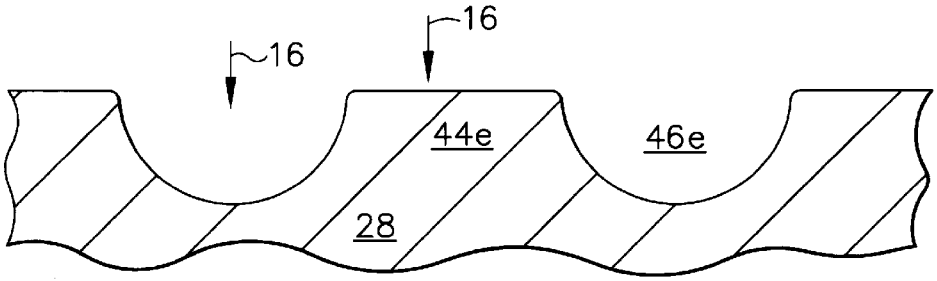
FIG. 7 is an enlarged sectional view of an alternate embodiment of the ridges and grooves illustrated in FIG. 3.

FIG. 7 illustrates yet another embodiment of the ridges and grooves of FIG. 3 designated 44*e* and 46*e,* respectively. The ridges 44*e* are flat in cross section at their tops and adjoin semicircular or concave grooves 46*e*.

In the five exemplary embodiments illustrated in FIGS. 3–7, the ridges and grooves are parallel to each other and preferably continuous along their lengths for basically defining two dimensional components which vary in configuration solely along their cross sections, while being identical along their lengths. These various configurations may be readily formed in the vane 22 illustrated in FIG. 2 for improving internal cooling thereof without introducing significant pressure losses.

In FIG. 2, the inner surface 40 of the airfoil wall defines the inner cavity 42 which extends radially along the span axis 32 at the upstream or forward end of the vane at the leading edge 36. And, an additional one of the inner cavities 42 may also be formed in the aft end of the vane near the trailing edge 38, with the two internal cavities beings separated by an integral rib extending between the pressure and suction sides.

In the forward cavity 42, the ridges 44 and grooves 46 preferably extend radially or along the span axis 32 over those portions of the vane inner surface for which additional cooling is desired. In FIG. 2, the ridges are disposed continuously over the inner surface behind the leading edge 36 and downstream behind the forward portions of the pressure and suction sides.

A particular advantage of the span ridges 44 and span grooves 46 is their ability to not only improve cooling heat transfer inside the vane during operation, but also reduce wear in the corresponding core die used for casting thereof.

Figure 8:
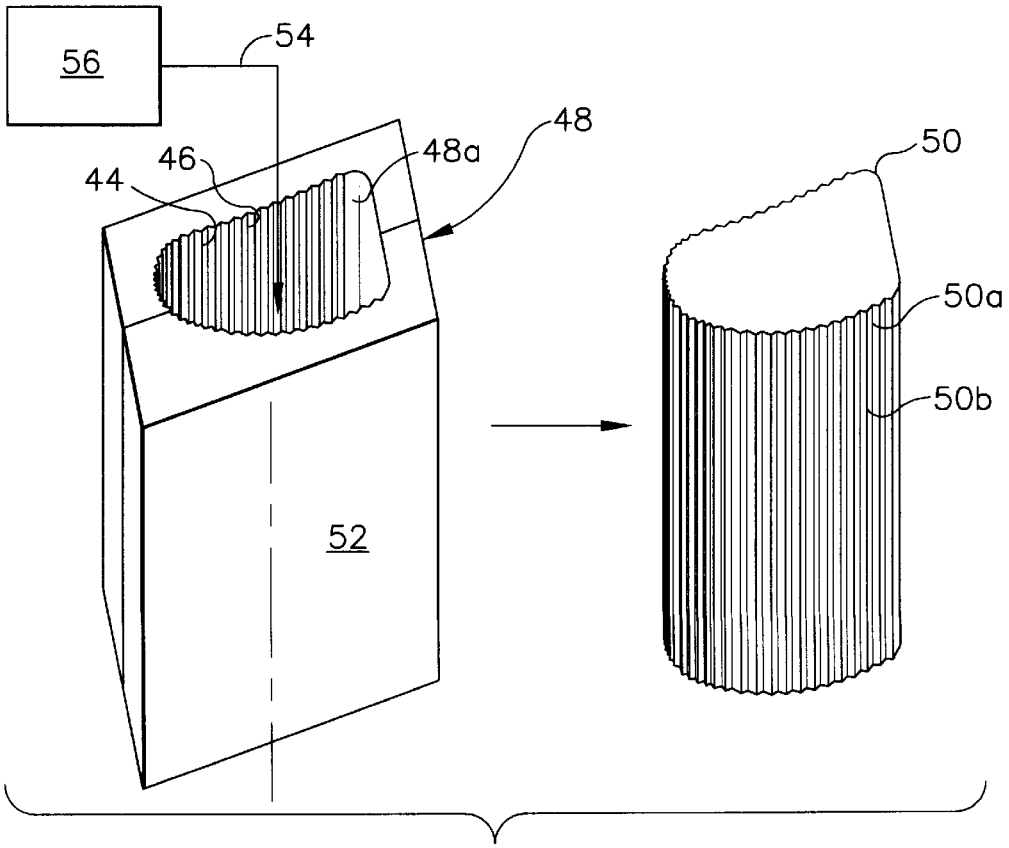
FIG. 8 is a schematic representation of making a ceramic core for casting a portion of the nozzle vane illustrated in FIG. 2.

FIG. 8 illustrates schematically a core die 48 used for making a ceramic core 50 which in turn is used for casting the forward cavity of the vane illustrated in FIG. 2. The core die 48 is typically in the form of a two piece metal shell having an inner cavity 48*a* matching the vane inner surface 40 in the forward cavity 42 illustrated in FIG. 2. The same ridges 44 and grooves 46 found in the vane 22 of FIG. 2 are initially provided in the core die 48 illustrated in FIG. 8. This is typically accomplished by precision milling of these features therein.

The core die 48 illustrated in FIG. 8 has a longitudinal axis 52 and is open at its top end for defining an inlet for receiving a ceramic slurry or paste 54 conventionally injected therein by a suitable ceramic injector 56. The ceramic 54 is injected into the cavity 48*a* along the span axis 52 for completely filling the cavity therewith. The ridges 44 and grooves 46 in this preferred embodiment extend parallel to the longitudinal axis 52 along which the ceramic is injected.

Since the ceramic is injected along the lengths of the ridges and grooves, they are subject to relatively less wear than if the ceramic were injected transversely across the ridges from side to side. By injecting the ceramic along the lengths of the ridges and grooves, the core die 48 may be used repetitively with reduced friction wear for enhanced life.

The resulting ceramic 54 is suitably cured to form the core 50 on which are formed grooves 50*a* which are mirror images to the span ridges 44, and ridges 50*b* which are mirror images of the span grooves 46. The ceramic core 50 is then used in conjunction with a second such core to define the forward and aft vane cavities, with a cooperating outer ceramic shell for casting the vane 22 illustrated in FIG. 2 in a conventional manner using the lost wax process.

A particular advantage of the ridges and grooves illustrated in FIG. 2 is their ability to improve impingement cooling inside the vane 22. The vane 22 preferably also includes an impingement baffle 58 which is disposed inside the inner cavity 42. The impingement baffle 58 may have any conventional configuration and is typically in the form of a thin metal shell perforated with impingement holes. The baffle 58 is spaced generally perpendicularly from the ridges 44 for impinging a portion of the cooling air 16 thereagainst.

An enlarged section of the impingement baffle 58 spaced from the vane wall 28 is illustrated in FIG. 3. The baffle is suitably mounted inside the vane for providing a baffle spacing E across which the cooling air 16 is directed in jets from the baffle apertures for impingement against the ridges and grooves.

The ridges 44 are relatively small for improving impingement cooling without introducing undesirable pressure losses therefrom. The height C of the ridges is preferably smaller than the baffle space in E. Preferably, the ridge height C is about an order of magnitude less than the baffle spacing E. As indicated above, the ridge height C is within the exemplary range of about 15–25 mils, with the baffle spacing E being in an exemplary range of about 100–150 mils. The ridges 44 and grooves 46 increase surface area effective for impingement cooling, and thereby increase the heat transfer cooling of the vane inner surface 40. The post-impingement air 16 may flow longitudinally along the lengths of the grooves 46 as well as in cross-flow over the ridges 44.

Referring again to FIG. 2, two impingement baffles 58 may be used in the forward and aft vane cavities for correspondingly providing impingement cooling therein. The aft vane cavity may also include the ridges and grooves for enhancing impingement cooling. As indicated above, the ridges, such as those in the forward cavity of the vane 22 of FIG. 2, preferably extend along the span axis 32 for reducing core die wear.

However, the ridges and grooves may have other orientations as desired. For example, the ridges and grooves illustrated in the aft cavity of the vane 22 in FIG. 2 are inclined between the span axis 32 and the chord axis 34. They are still effective for improving impingement cooling although they are prone to more wear in the corresponding core die than ridges formed solely along the span axis. Since the ridges and grooves are relatively small in height and are symmetrical along their lengths, core die wear is nevertheless relatively little for this configuration.

As indicated above, the nozzle vanes 22 and impingement baffles 58 therein may have any conventional configuration which may obtain improved cooling performance by the introduction of the cooperating ridges 44 and grooves 46 in various embodiments. The vanes 22 may have other conventional forms of cooling in addition thereto such as various rows of film cooling holes 60 extending through the vane walls along the pressure and suction sides thereof as desired. The spent impingement cooling air from the forward and aft vane cavities is conveniently discharged through the film cooling holes 60 for effecting cooling air films on the external surface of the vane for providing a barrier against the heating effects of the combustion gases 20 which flow over the vanes.

Figure 9:
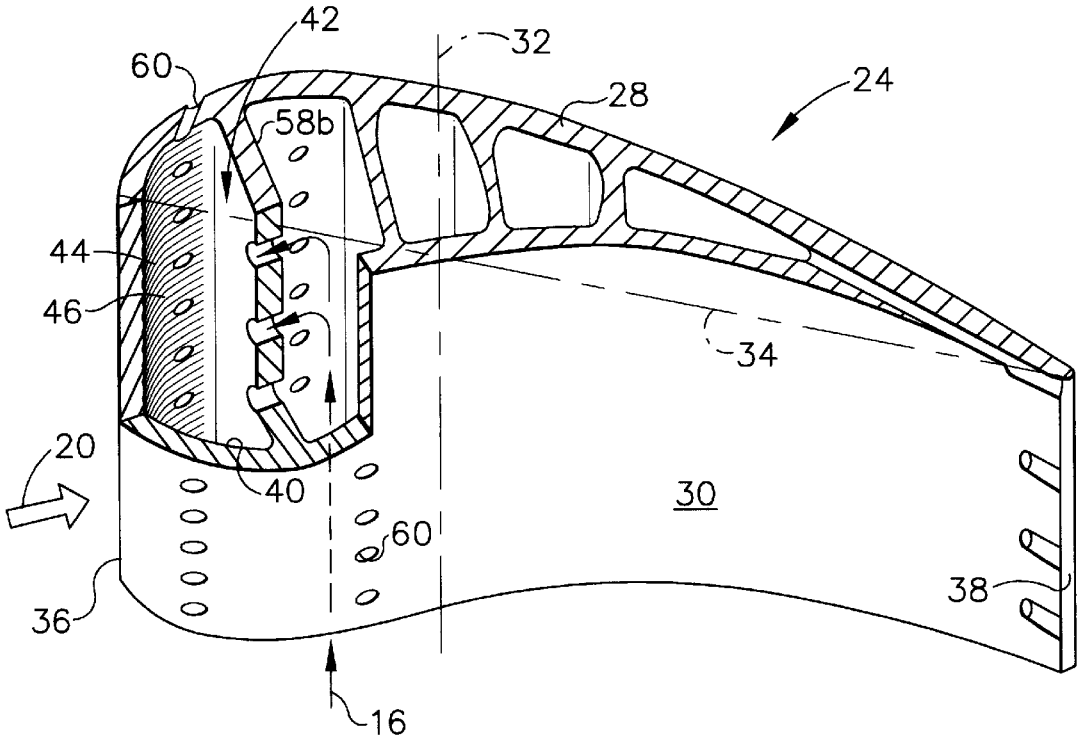
FIG. 9 is a partly sectional, isometric view of a portion of one of the turbine blades illustrated in FIG. 1 and taken generally along line 9—9.

The ridges and grooves may be used in other components of the turbine for improving impingement cooling thereof. For example, FIG. 9 illustrates a portion of the first stage turbine blade 24 which may be modified to incorporate the ridges and grooves. Like the vane 22 illustrated in FIG. 2, the blade 24 illustrated in FIG. 9 is also in the form of an airfoil suitably configured for its specific function. Accordingly, similar components of the vane 22 and blade 24 are labeled with the same reference numerals.

For example, the blade 24 illustrated in FIG. 9 includes a wall 28 defining a corresponding airfoil having an outer surface 30 exposed to the combustion gases 20 during operation. The outer surface 30 includes a generally concave pressure side, and an opposite generally convex suction side which extend longitudinally or radially along a span axis 32, and laterally along a chord axis 34.

The blade airfoil includes an inner surface 40 defining an inner cavity 42 extending longitudinally along the span axis 32 from the root to the tip of the blade for channeling the cooling air 16 against the backside of the leading edge in impingement thereagainst.

The blade airfoil typically includes several of the inner cavities between the leading and trailing edges 36,38 of the airfoil which may be configured in various conventional manners for internally cooling the blade. For example, some of the inner cavities may be linked together to provide serpentine cooling with or without corresponding wall turbulators therein.

Since the leading edge 36 of the rotor blade first encounters the combustion gases 20, it typically includes a dedicated cooling circuit therefor. By introducing the ridges 44 and grooves 46 in the leading edge cavity 42 of the blade 24, improved cooling may be obtained in an otherwise conventional rotor blade, also including rows of the film cooling holes 60.

Since the blade 24 rotates during operation, whereas the vane 22 is stationary during operation, an impingement baffle is introduced in the blade illustrated in FIG. 9 by an integral, perforated rib or bridge 58*b* which extends between the pressure and suction sides to define the leading edge forward cavity 42. By positioning the bridge baffle 58*b* adjacent the forward cavity 42, the impingement holes in the baffle direct a portion of the cooling air 16 in the axial direction toward the inner surface 40 around the blade leading edge 36. The impingement air thusly engages the ridges 44 and grooves 46 inside the blade leading edge for improving impingement cooling thereat in the same manner as provided in the vane illustrated in FIG. 2.

The ridges and grooves illustrated in FIG. 9 may have any of the configurations disclosed for the vane 22 described above for also enjoying the benefits therefrom. For example, referring to FIG. 3 in addition to FIG. 9, the height C of the ridges 44 for the turbine blade is also preferably smaller than the corresponding baffle spacing E between the inside of the blade leading edge 36 and the bridge baffle 58*b* over most of the leading edge. The ridges and grooves may be introduced wherever desirable in the leading edge cavity 42, and may additionally cooperate with the conventional film cooling holes 60 extending through the airfoil wall which receive spent impingement air from the cavity.

In the exemplary embodiment illustrated in FIG. 9, the ridges 44 extend along the direction of the chord axis 34 instead of along the span axis 32. Since the blade rotates during operation, the cooling air 16 channeled therethrough is subject to centrifugal force including Coriolis forces which produce secondary flow fields that may additionally enhance cooling by cooperating with the chord ridges 44. However, the ridges 44 may alternatively be oriented solely along the span axis 32 similar to those illustrated in the forward cavity of the FIG. 2 vane, or may be inclined as in the aft cavity of the FIG. 2 vane.

Figure 10:
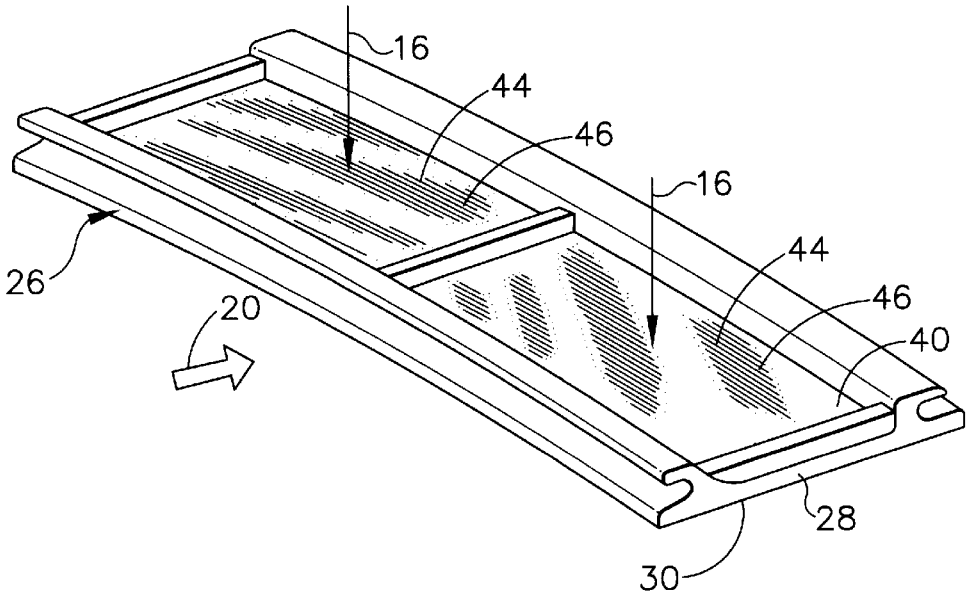
FIG. 10 is a isometric view of an arcuate segment of the turbine shroud illustrated in FIG. 1 and taken generally along line 10—10.

FIG. 10 illustrates yet another application of the ridges 44 and grooves 46 applied to the segments of the turbine shroud 26. The shroud and its segments may have any conventional configuration but for the introduction of the ridges 44 and grooves 46 therein. Each segment of the shroud 26 typically includes forward and aft rails which engage complementary forward and aft hooks for mounting the shroud in the turbine case as illustrated in FIG. 1. The central portion of the shroud hangar, designated 58*c*, channels air radially inwardly through a corresponding impingement baffle for impingement cooling the shroud in a conventional manner.

As shown in FIG. 10, the shroud segment is in the form of an arcuate panel or wall 28 having an outer surface 30 which is arcuate and faces radially inwardly above the row of turbine blades 24 as shown in FIG. 1. The shroud wall 28 has an inner surface 40 which faces radially outwardly and is open and exposed to the cooling air 16 directed thereagainst. The cooling air 16 is isolated behind or inside the shroud 26 radially above the blade row for providing impingement cooling of the shroud. The ridges 44 and grooves 46 are disposed in the shroud inner surface 40 for enhancing impingement cooling thereof in basically the same manner as indicated above for the vanes 22 and blades 24. Like those other embodiments, the ridges 44 and grooves 46 may have any of the configurations disclosed above and suitable orientations as desired.

For example, the ridges 44 and grooves 46 preferably extend circumferentially along the shroud inner surface 40 in the direction of blade rotation. In this way, additional cross-flow advantages of the spent impingement air are obtained as the air is channeled through film cooling holes (not shown) in the shroud panel or around the forward and aft rails thereof. The spent impingement cooling air is also readily distributed circumferentially around the circumference of the shroud without significant pressure loss along the lengths of the ridges and grooves.

By the simple introduction of the two-dimensional ridges 44 and corresponding grooves 46 in otherwise conventional turbine components, improved impingement cooling may be obtained without significant pressure losses. And, advantages in casting may also be obtained. For spanwise directed ridges and grooves in the vanes and blades, the corresponding core dies therefor enjoy less wear and may be used for producing more vanes and blades over their useful life. The turbine shrouds 26 are also typically cast in the lost wax process, without the need for core dies in view of their different configuration, and die wear is not a concern.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which I claim:

1. A turbine wall comprising an outer surface for facing combustion gases; an opposite inner surface for being air cooled; and a plurality of adjoining parallel and elongate ridges and grooves in said inner surface being generally equal in width; and being sized in height to exceed a boundary layer thickness of said cooling air for increasing heat transfer.

2. A wall according to claim 1 wherein said ridges are substantially equal in height.

3. A wall according to claim 2 wherein said ridges and grooves are sized and configured to increase area of said inner surface thereat by about 100%.

4. A wall according to claim 2 wherein said ridges are convex.

5. A wall according to claim 4 wherein said grooves are flat between adjacent ridges.

6. A wall according to claim 2 wherein said ridges are triangular.

7. A wall according to claim 6 wherein said grooves are triangular.

8. A wall according to claim 2 wherein said ridges are flat between adjacent grooves.

9. A wall according to claim 8 wherein said ridges are rectangular.

10. A wall according to claim 9 wherein said grooves are rectangular.

11. A wall according to claim 2 in the form of an airfoil, and wherein:

said outer surface defines pressure and suction sides of said airfoil extending longitudinally along a span axis and laterally along a chord axis; and said inner surface defines an inner cavity extending along said span axis.

12. An airfoil according to claim 11 wherein said ridges extend along said span axis.

13. An airfoil according to claim 11 wherein said ridges extend along said chord axis.

14. An airfoil according to claim 11 further comprising an impingement baffle disposed along said inner cavity, and spaced from said ridges for impinging said cooling air thereagainst.

15. An airfoil according to claim 14 wherein said ridges have a height smaller than said baffle spacing.

16. An airfoil according to claim 15 wherein said ridge height is about an order of magnitude less than said baffle spacing.

17. An airfoil according to claim 14 in the form of a turbine nozzle vane.

18. A vane according to claim 17 wherein said baffle is disposed inside said cavity.

19. A vane according to claim 18 wherein said ridges extend along said span axis.

20. An airfoil according to claim 14 in the form of a turbine rotor blade.

21. A blade according to claim 20 wherein said baffle forms a bridge extending integrally between said pressure and suction sides at a leading edge of said airfoil.

22. A wall according to claim 2 in the form of a turbine shroud wherein:

said outer surface is arcuate to face radially inwardly above a row of turbine blades; and said inner surface is outwardly exposed.

23. A shroud according to claim 22 wherein said ridges extend circumferentially along said inner surface.

24. A turbine wall comprising an outer surface for facing combustion gases; an opposite inner surface for being air cooled; and a plurality of adjoining parallel ridges and grooves in said inner surface, and wherein said grooves are concave, and said ridges are convex.

25. A turbine wall comprising an outer surface for facing combustion gases; an opposite inner surface for being air cooled; and a plurality of adjoining parallel ridges and grooves in said inner surface, and wherein said grooves are concave, and said ridges are flat between adjacent grooves.

26. An airfoil comprising:

an outer surface defining pressure and suction sides extending longitudinally along a span axis and laterally along a chord axis for facing combustion gases;

an opposite inner surface defining an inner cavity of said airfoil extending along said span axis for being air cooled;

a plurality of adjoining parallel ridges and grooves in said inner surface, and wherein said ridges are inclined between said span and chord axes.

27. A turbine rotor blade comprising:

an outer surface defining pressure and suction sides of an airfoil extending longitudinally along a span axis and laterally along a chord axis for facing combustion gases;

an opposite inner surface defining an inner cavity of said airfoil extending along said span axis for being air cooled;

a plurality of adjoining parallel ridges and grooves in said inner surface, wherein said ridges extend along said chord axis; and an impingement baffle forming a bridge extending integrally between said pressure and suction sides at a leading edge of said airfoil along said inner cavity, and spaced from said ridges for impinging said cooling air thereagainst.

28. A turbine nozzle vane comprising:

an outer surface defining pressure and suction sides extending longitudinally along a span axis and laterally along a chord axis;

an inner surface defining an inner cavity extending along said span axis for channeling cooling air; and a plurality of adjoining parallel and elongate ridges and grooves in said inner surface being generally equal in width, and being sized in height to exceed a boundary layer thickness of said cooling air for increasing heat transfer.

29. A vane according to claim 28 further comprising an impingement baffle disposed inside said cavity and spaced from said ridges and grooves for impinging said cooling air thereagainst.

30. A vane according to claim 29 wherein said ridges have a height smaller than said baffle spacing.

31. A turbine nozzle vane comprising:

an outer surface defining pressure and suction sides extending longitudinally along a span axis and laterally along a chord axis;

an inner surface defining an inner cavity extending along said span axis for channeling cooling air;

a plurality of adjoining ridges and grooves in said inner surface for being cooled by said air; and an impingement baffle disposed inside said cavity and spaced from said ridges and grooves for impinging said cooling air thereagainst; and wherein said ridges are sized in height to exceed a boundary layer thickness of said cooling air for increasing heat transfer.

32. A vane according to claim 31 wherein said ridges extend along said span axis.

33. A turbine rotor blade comprising:

an outer surface defining pressure and suction sides extending longitudinally along a span axis and laterally along a chord axis;

an inner surface defining an inner cavity extending along said span axis for channeling cooling air; and a plurality of adjoining parallel and elongate ridges and grooves in said inner surface being generally equal in width, and being sized in height to exceed a boundary layer thickness of said cooling air for increasing heat transfer.

34. A blade according to claim 33 further comprising an impingement baffle disposed adjacent said cavity and spaced from said ridges and grooves for impinging said cooling air thereagainst.

35. A blade according to claim 34 wherein said ridges have a height smaller than said baffle spacing.

36. A turbine rotor blade comprising:

an outer surface defining pressure and suction sides extending longitudinally along a span axis and laterally along a chord axis;

an inner surface defining an inner cavity extending along said span axis for channeling cooling air;

a plurality of adjoining ridges and grooves in said inner surface for being cooled by said air;

an impingement baffle disposed inside said cavity and spaced from said ridges and grooves for impinging said cooling air thereagainst; and wherein said ridges are sized in height to exceed a boundary layer thickness of said cooling air for increasing heat transfer.

37. A blade according to claim 36 wherein said ridges extend along said chord axis.

38. A turbine shroud comprising:

an outer surface being arcuate to face radially inwardly above a row of turbine blades;

an opposite inner surface being outwardly exposed for being impingement air cooled; and a plurality of adjoining parallel and elongate ridges and grooves in said inner surface being generally equal in width, and being sized in height to exceed a boundary layer thickness of said cooling air for increasing heat transfer.

39. A shroud according to claim 38 wherein said ridges are substantially equal in height.

40. A turbine shroud comprising:

an outer surface being arcuate to face radially inwardly above a row of turbine blades;

an opposite inner surface being outwardly exposed for being impingement air cooled; and a plurality of adjoining parallel ridges and grooves in said inner surface for being impingement cooled by said air; and wherein said ridges are sized in height to exceed a boundary layer thickness of said cooling air for increasing heat transfer.

41. A shroud according to claim 40 wherein said ridges and grooves are generally equal in width.

42. A shroud according to claim 41 wherein said ridges extend circumferentially along said inner surface.

43. A core die for making a core for casting a turbine airfoil having opposite outer and inner surfaces, with a plurality of adjoining ridges and grooves extending along said inner surface, comprising:

a shell having an inner cavity matching said airfoil inner surface with ridges and grooves therein for forming mirror features around said core; and wherein said shell has a longitudinal axis and is open at an inlet end, and said ridges are parallel to said longitudinal axis.

* * * * *